US012723422B2

(12) United States Patent
Chen et al.

(10) Patent No.: US 12,723,422 B2
(45) Date of Patent: Sep. 1, 2026

(54) SWIMMING POOL FRAME WITH ROTATION-RESISTANT SUPPORT MEMBERS

(71) Applicant: BESTWAY INFLATABLES & MATERIAL CORP., Shanghai (CN)

(72) Inventors: Xiaobo Chen, Jinhua City (CN); Hongjiang Xiong, Jinhua City (CN); Zhipeng Dai, Jinhua City (CN); Feng Ye, Jinhua City (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 220 days.

(21) Appl. No.: 18/630,812

(22) Filed: Apr. 9, 2024

(65) Prior Publication Data

US 2025/0084656 A1 Mar. 13, 2025

(30) Foreign Application Priority Data

Sep. 13, 2023 (CN) ..... 202322489113.X

(51) Int. Cl.
*E04H 4/00* (2006.01)

(52) U.S. Cl.
CPC ..... *E04H 4/005* (2013.01)

(58) Field of Classification Search
CPC ..... E04H 4/005; E04H 4/0056; E04H 4/00; A63B 31/00
USPC ..... 4/488, 506; 482/55
See application file for complete search history.

(56) References Cited

U.S. PATENT DOCUMENTS 5,083,327 A * 1/1992 Gillebaard ..... E04H 4/0056 220/4.16
5,592,702 A * 1/1997 Gillebaard, Jr. ..... E04H 4/0056 4/585
6,604,250 B1 * 8/2003 Lee ..... E04H 4/0056 4/506

(Continued)

FOREIGN PATENT DOCUMENTS

CN 204531509 U * 8/2015 ..... E04H 4/0056
CN 205777703 U * 12/2016 ..... E04H 4/0056

(Continued)

OTHER PUBLICATIONS

Extended European Search Report dated Oct. 28, 2024 (Oct. 28, 2024), 7 pages, issued on related European Patent Application 24175434.0 by the European Patent Office.

*Primary Examiner* — Lori L Baker
(74) *Attorney, Agent, or Firm* — Dickinson Wright PLLC

(57) ABSTRACT

A swimming pool frame includes a plurality of side members connected together to form a frame bounding an interior area, a plurality of leg members, and a plurality of joints. Each joint is connected between two adjacent side members, and a leg member is connected to each joint. Each of the side members and leg members have a non-circular cross-sectional profile that include shapes such as polygonal or elliptical shapes, and each joint includes similarly-shaped side member insertion channels and a leg member insertion channel. Each end of each side member is adapted to be inserted into a side member insertion channel of the joint, and an upper end of each leg member is adapted to be inserted into the leg member insertion channel. A retention pin is connected between each side member insertion channel and a corresponding side member.

22 Claims, 5 Drawing Sheets

(56) References Cited

U.S. PATENT DOCUMENTS

| | | | | |
|---|---|---|---|---|
| 10,246,891 | B2 * | 4/2019 | Huang | E04H 4/0056 |
| 11,225,805 | B2 * | 1/2022 | Huang | E04H 4/0056 |
| 11,479,985 | B2 * | 10/2022 | Huang | E04H 4/0056 |
| 2007/0199141 | A1 * | 8/2007 | Johnston | E04H 4/108 4/498 |
| 2016/0222686 | A1 * | 8/2016 | Liu | E04H 4/0056 |
| 2021/0348409 | A1 * | 11/2021 | Chen | F16B 7/042 |
| 2022/0090401 | A1 * | 3/2022 | Ramos | F16B 7/185 |
| 2023/0323692 | A1 * | 10/2023 | Ramos | E04H 4/0056 4/506 |

FOREIGN PATENT DOCUMENTS

| | | | | | |
|---|---|---|---|---|---|
| CN | 212583381 | U * | 2/2021 | | E04H 4/0056 |
| EP | 3255226 | A1 * | 12/2017 | | E04H 4/0056 |
| EP | 4632172 | A1 * | 10/2025 | | E04H 4/0056 |
| JP | 2021011764 | A * | 2/2021 | | E04H 4/108 |
| JP | 6867708 | B2 * | 5/2021 | | E04H 4/108 |
| WO | WO-2017218904 | A1 * | 12/2017 | | F16B 7/14 |
| WO | WO-2020058854 | A1 * | 3/2020 | | F16B 7/042 |
| WO | WO-2022040227 | A1 * | 2/2022 | | E04H 4/0056 |
| WO | WO-2022087639 | A1 * | 4/2022 | | E04H 4/0056 |
| WO | WO-2025049538 | A1 * | 3/2025 | | E04H 4/0056 |

* cited by examiner

SWIMMING POOL FRAME WITH ROTATION-RESISTANT SUPPORT MEMBERS

CROSS-REFERENCE TO RELATED APPLICATION

This Application claims priority from Chinese Application CN202322489113.X, filed Sep. 13, 2023 in China, the disclosure of which is incorporated herein by reference in its entirety.

BACKGROUND

1. Field

Example embodiments relate to a swimming pool structure, and more particularly to a swimming pool frame with polygonal support members.

2. Description of Related Art

Above-ground swimming pools are widely used due to their convenient layout and low cost. Many above-ground swimming pools are arranged such that the whole swimming pool is supported by a swimming pool frame, an inner liner is supported within the swimming pool frame, and when the inner liner is filled with pool water, the entire structure is stable. A swimming pool frame is often comprised of side members and leg members, where most of the side members and leg members are round pipes, which rotate easily. As a result, retention pins for positioning are subjected to high torque/bearing forces in a circumferential direction. Thus, the retention pins not only bear axial loads, but also bear circumferential loads, resulting in high bearing forces and a high risk of damage.

SUMMARY

Example embodiments may address at least the above problems and/or disadvantages and other disadvantages not described above. Also, example embodiments are not required to overcome the disadvantages described above, and may not overcome any of the problems described above.

According to an aspect of an example embodiment, a swimming pool frame comprises: a plurality of side members, each of the plurality of side members including respective ends having respective side member insertion sections with respective non-circular cross-sectional shapes, the side members being configured to be connected together to form a frame bounding an interior area; a plurality of leg members, each of the plurality of leg members including a leg member insertion section at an end thereof, the leg member insertion section having a non-circular cross-sectional shape; a plurality of joints, each configured to be connected between two adjacent side members and one of the leg members, each of the plurality of joints comprising: two side member insertion channels having a non-circular internal cross-sectional shape, wherein the side member insertion channels are configured to receive an end of one of the plurality of side members in one of the two side member insertion channels and an end of another one of the plurality of side members in the other of the two side member insertion channels; a leg member insertion channel having a non-circular internal cross-sectional shape configured to receive an end of one of the plurality of leg members in the leg member insertion channel; and a retention pin configured to be inserted through and retained between each side member insertion channel and an end of a corresponding one of the plurality of side members.

Each end of each of the plurality of side members may comprise a side member insertion section formed by swaging the end of the side member to a reduced diameter thereof, the side member insertion section configured to be inserted into a corresponding side member insertion channel of one of the plurality of joints, and each end of each of the plurality of side members further comprises a bevel formed between the side member insertion section and a middle portion of the side member.

An upper end of each of the plurality of leg members comprises a leg member insertion section formed by swaging the upper end of the leg member to a reduced diameter thereof, the leg member insertion section configured to be inserted into a corresponding leg member insertion channel of one of the plurality of joints, and the upper end of each of the plurality of leg members further comprises a bevel formed between the leg member insertion section and a middle portion of the leg member.

Additionally, a clamping section of each of the plurality of leg members may be formed by swaging a top end of each of the leg member insertion sections proximate an upper edge of each of the plurality of leg members to a second reduced diameter thereof, each clamping section configured to be inserted into a corresponding clamping groove of one of the plurality of joints; and a distal bevel is formed between each of the clamping sections of each of the plurality of leg members and the respective leg member insertion sections of each of the plurality of leg members.

In one aspect, the side member insertion sections of each of the plurality of side members have a cross-sectional shape comprising one of a regular polygonal shape, an irregular polygonal shape, or an elliptical shape. The cross-sectional shape of the side member insertion sections may also comprise a regular octagonal polygon shape as shown in an illustrated embodiment. In an additional aspect, the leg member insertion section of each of the plurality of leg members may have a cross-sectional shape comprising one of a regular polygonal shape, an irregular polygonal shape, or an elliptical shape. Further, the cross sectional shape of the leg member insertion sections may comprise a regular octagonal polygon shape as shown in an illustrated embodiment.

In another embodiment, the swimming pool frame may further comprise a plurality of locking seats, each configured to mount inside an internal end of a side member insertion channel of one of the plurality of joints, wherein each of the plurality of retention pins is mounted on one of the plurality of locking seats.

Each of the plurality of locking seats may comprise a flange ring disposed at an end of the locking seat and configured to be supported on an end face of an opening of one of the plurality of side members when one of the side member insertion sections of the one of the plurality of side members is inserted within the side member insertion channel.

Each of the plurality of locking seats may further comprise a plurality of protrusions extending radially outward from the flange ring, wherein each side member insertion channel of each of the plurality of joints includes a plurality of clamping grooves disposed at positions corresponding to positions of the plurality of protrusions, such that the protrusions are disposed within the clamping grooves when one of the plurality of locking seats is mounted inside of the side member insertion channel.

Each of the plurality of leg members, the plurality of joints, and the plurality of locking seats may be physically shaped such that, upon insertion of the leg member insertion section of one of the plurality of leg members into the leg member insertion channel of one of the plurality of joints where of one of the plurality of locking seats has been mounted into the side member insertion channel of the one of the plurality of joints, a clamping section formed in the leg member insertion section proximate an upper edge of the leg member extends to the lower side of the side member insertion channel, and one of the plurality of protrusions clamps onto on an inner wall of the leg member within the clamping section.

Additionally, each of the plurality of joints may further comprise a pair of reinforcing rib plates disposed on an outer wall of the joint and extending between each of the side member insertion channels and the leg member insertion channel, and a locking hole formed through the outer wall of the joint between each pair of reinforcing rib plates, wherein the retention pin may be inserted into the locking hole. In one aspect, a portion of each of the locking seats has a cross-sectional shape comprising one of a regular polygonal shape, an irregular polygonal shape, or an elliptical shape.

More generally, a cross-sectional shape of a side member insertion section or a leg member insertion section may be, in various embodiments, non-circular. Likewise, in various embodiments, a cross-sectional shape of an interior region of the side member insertion channel (or leg member insertion channel) of the joint has a non-circular shape, and is configured to receive the respective side member insertion section (or leg member insertion section) when inserted within such respective insertion channels, so that the joint may provide resistance against rotation of the respective inserted side member or leg member when installed within the joint when a centrifugal force or torque is applied to the respective side or leg members (e.g., when a force is applied to such side or leg members that would urge such members to rotate around their long central axes).

According to another example embodiment, a swimming pool joint unit is provided and may comprise: a frame joint, comprising a pair of side member insertion channels, each having a first polygonal cross-sectional shape and each configured to receive therein an end of a side member, each of the pair of side member insertion channels comprising a locking hole formed through an outer wall thereof; and a leg member insertion channel having a second polygonal cross-sectional shape and configured to receive therein an end of a leg member.

In one aspect, each of the first polygonal cross-sectional shape and the second polygonal cross-sectional shape may comprise a regular polygonal shape. Alternatively, each of the first polygonal cross-sectional shape and the second polygonal cross-sectional shape may comprise an irregular polygonal shape.

The frame joint may further comprises a first pair of reinforcing rib plates disposed on an outer wall of the joint and extending between the leg member insertion channel and a first one of the pair of side member insertion channels; and a second pair of reinforcing rib plates disposed on the outer wall of the joint and extending between the leg member insertion channel and a second one of the pair of side member insertion channels, wherein a first locking hole is formed through the outer wall of the first one of the pair of side member insertion channels between the first pair of reinforcing rib plates, and a second locking hole is formed through the outer wall of the second one of the pair of side member insertion channels between the second pair of reinforcing rib plates.

The swimming pool joint unit may further comprise: a first locking seat configured to fit within a first one of the pair of side member insertion channels and comprising a first flange ring and a first retention pin configured to extend through the locking hole of the first one of the pair of side member insertion channels; and a second locking seat configured to fit within a second one of the pair of side member insertion channels and comprising a second flange ring and a second retention pin configured to extend through the locking hole of the second one of the pair of side member insertion channels. In yet another embodiment, the first locking seat may further comprise a plurality of first protrusions extending radially outward from the first flange ring; the second locking seat may further comprise a plurality of second protrusions extending radially outward from the second flange ring; and the frame joint may further comprise: a first plurality of clamping grooves formed within the first one of the pair of side member insertion channels and configured to accept the plurality of first protrusions when the first retention pin is extended through and retained within the locking hole of the first one of the pair of side member insertion channels; and a second plurality of clamping grooves formed within the second one of the pair of side member insertion channels and configured to accept the plurality of second protrusions when the second retention pin is extended through and retained within the locking hole of the second one of the pair of side member insertion channels.

BRIEF DESCRIPTION OF THE DRAWINGS

The above and/or other aspects will become apparent and more readily appreciated from the following description of example embodiments, taken in conjunction with the accompanying drawings, in which.

DETAILED DESCRIPTION

Figure 1:
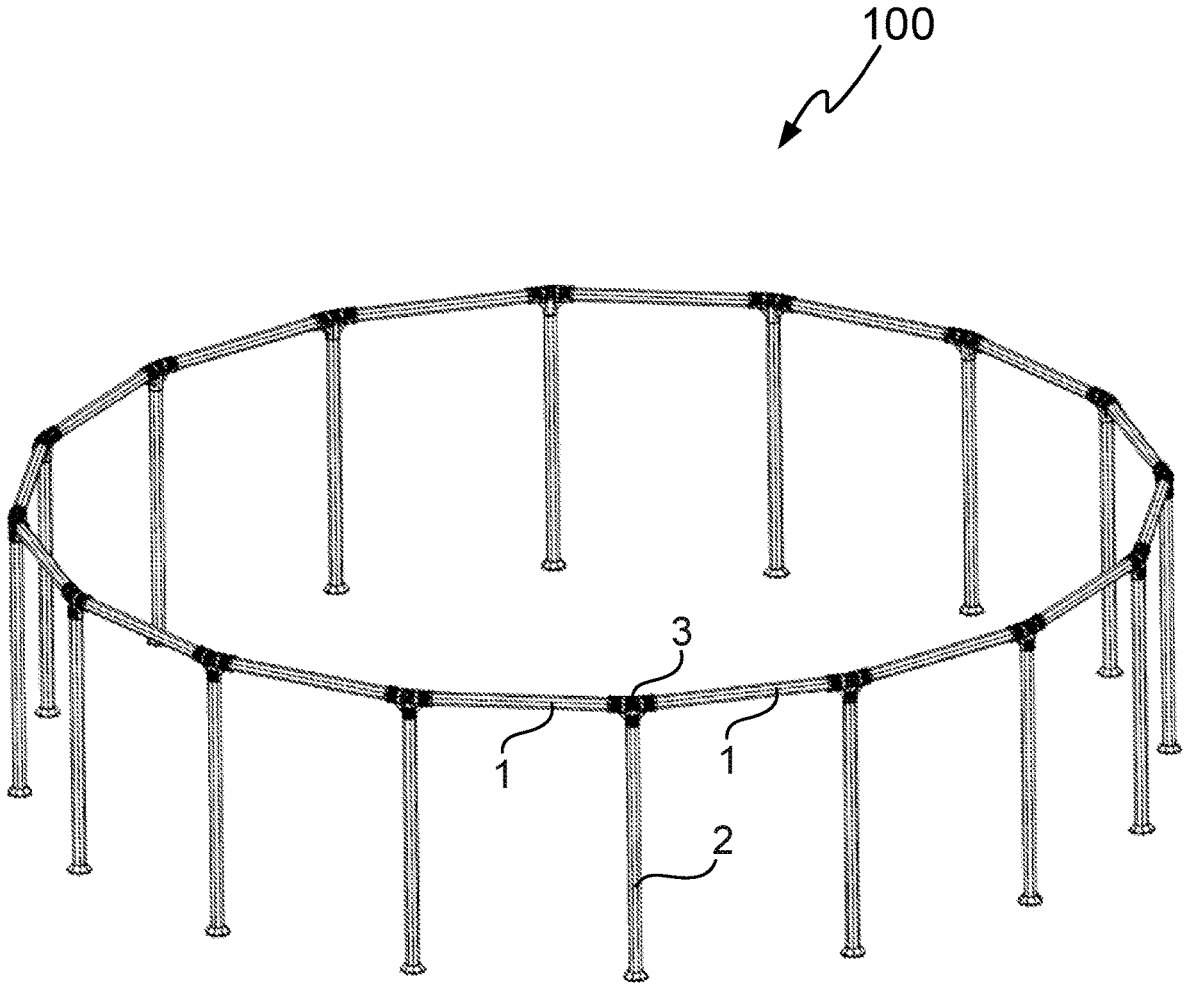
FIG. 1 is a schematic diagram of a structure according to an example embodiment.

Reference will now be made in detail to example embodiments which are illustrated in the accompanying drawings, wherein like reference numerals refer to like elements throughout. In this regard, the example embodiments may have different forms and may not be construed as being limited to the descriptions set forth herein.

It will be understood that the terms "include," "including," "comprise," and/or "comprising," when used in this specification, specify the presence of stated features, integers, steps, operations, elements, and/or components, but do not preclude the presence or addition of one or more other features, integers, steps, operations, elements, components, and/or groups thereof.

It will be further understood that, although the terms "first," "second," "third," etc., may be used herein to describe various elements, components, regions, layers and/or sections, these elements, components, regions, layers and/or sections may not be limited by these terms. These terms are only used to distinguish one element, component, region, layer or section from another element, component, region, layer or section.

As used herein, the term "and/or" includes any and all combinations of one or more of the associated listed items. Expressions such as "at least one of," when preceding a list of elements, modify the entire list of elements and do not modify the individual elements of the list.

Matters of these example embodiments that are obvious to those of ordinary skill in the technical field to which these example embodiments pertain may not be described here in detail.

Figure 2:
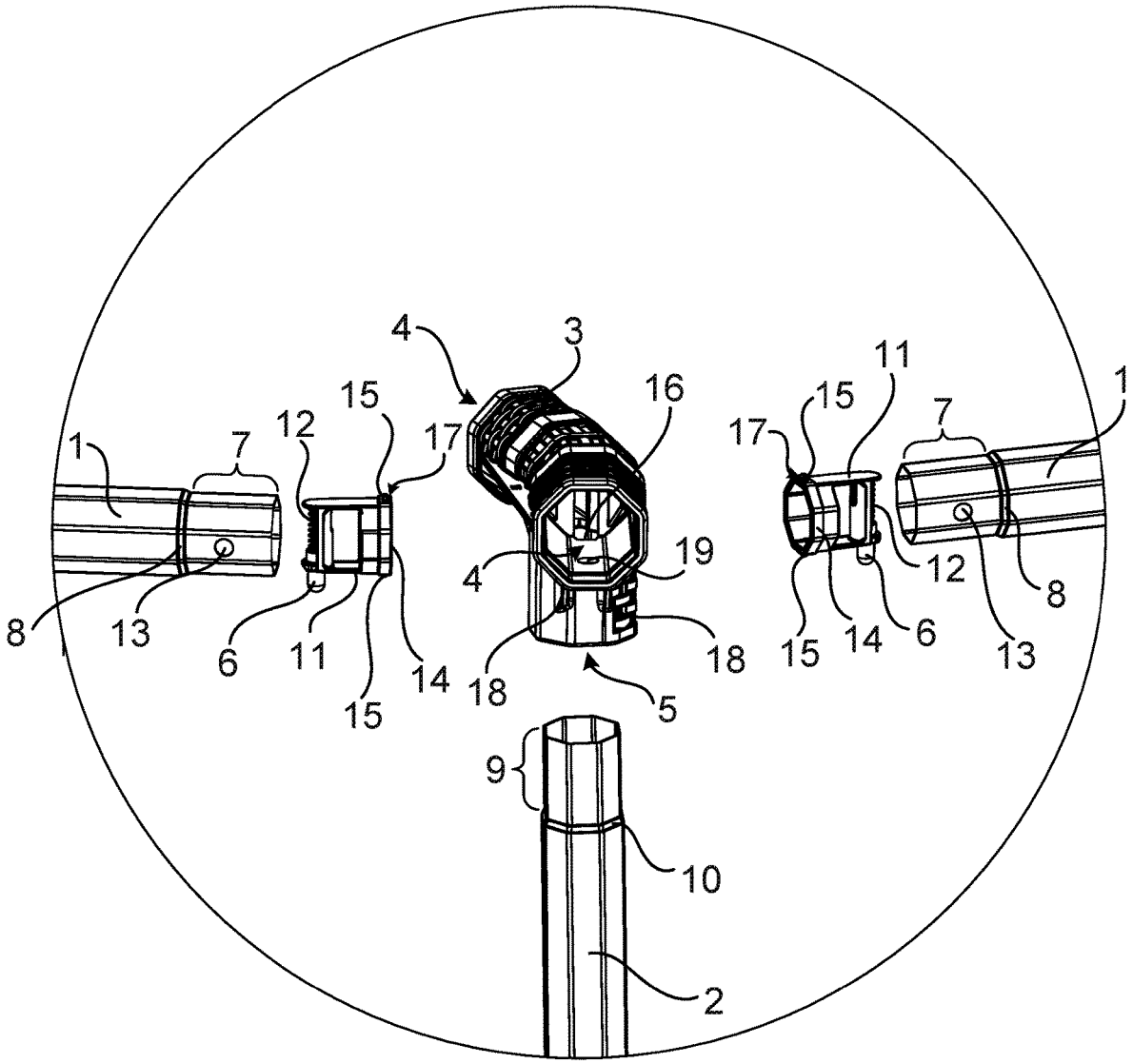
FIG. 2 is a partial exploded view of the structure of an example embodiment.

According to a first example embodiment shown in FIGS. 1 and 2, a swimming pool frame 100 comprises an approximately circular frame formed from a plurality of side members 1, and a plurality of leg members 2 connected to the swimming pool frame 100. The side members 1 and leg members 2 may appear somewhat tubular in form, but exterior shapes of the side members 1 and leg members 2 may include various exterior profiles that may be illustrated by non-circular cross-sectional structures described below. A joint 3, in one embodiment, is made from plastic or resin, and is configured to be connected between each two adjacent side members 1. Each of the side members 1 and the leg members 2 may be made of metal. Each joint 3 includes side member insertion channels 4 and a leg member insertion channel 5. Cross-sectional interior structures of the side member insertion channels 4 and leg member insertion channels 5 may be non-circular in shape. An end of each corresponding side member 1, corresponding to an insertion section 7, is adapted to be inserted into a side member insertion channel 4 of a joint 3, and an upper end of a corresponding leg member 2, corresponding to an insertion section 9, is adapted to be inserted into the leg member insertion channel 5. A retention pin 6 may be inserted and connected between the side member 1 and the joint 3.

In one embodiment, the side member insertion section 7 is formed by swaging an end of the side member 1 to a reduced diameter thereof, and the insertion section 7 is thus configured to be inserted into the side member insertion channel 4 of the joint 3. A bevel 8 is formed between the insertion section 7 and the remainder of the side member 1 and, when the insertion section 7 is inserted into the side member insertion channel 4, the bevel 8 is made to approximate an edge 8A of an interior bore of the side member insertion channel 4. In another embodiment, a leg member insertion section 9 may be formed by swaging the upper end of the leg member 2 to a reduced diameter thereof, and the leg member insertion section 9 is thus configured to be inserted into the leg member insertion channel 5 of the joint 3. A bevel 10 is formed between the insertion section 9 and the remainder of the leg member 2 and, when the insertion section 9 is inserted into the leg member insertion channel 5, the bevel 10 approximates an edge 10A of an interior bore of the leg member insertion channel 5.

In the illustrated example embodiments shown in FIGS. 1-3A, the side members 1 and leg members 2 each have a regular octagonal cross-sectional profile along their entire lengths. In such an embodiment, the lengths of the members having polygonal cross-sections provide further structural advantages including longitudinal ridges that reduce flexure when such members are subjected to bending forces. However, alternate embodiments provide for variations on the geometry of the referenced illustrated embodiments.

Figure 4A:
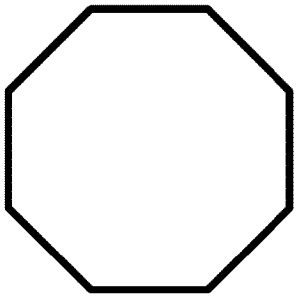
FIG. 4A illustrates a cross-sectional view taken from a direction orthogonal to a long axis of a portion of an exemplary leg or side member of the present invention, corresponding to a shape of an octagonal regular polygon.
Figure 4B:
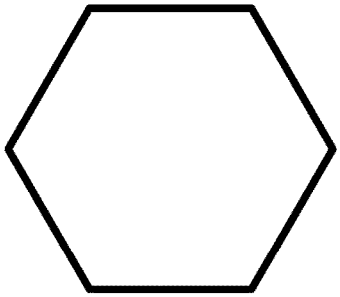
FIG. 4B illustrates a cross-sectional view taken from a direction orthogonal to a long axis of a portion of an exemplary leg or side member of the present invention, corresponding to a shape of a hexagonal regular polygon.
Figure 4C:
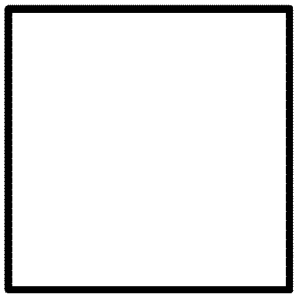
FIG. 4C illustrates a cross-sectional view taken from a direction orthogonal to a long axis of a portion of an exemplary leg or side member of the present invention, corresponding to a shape of a quadrilateral regular polygon.
Figure 4D:
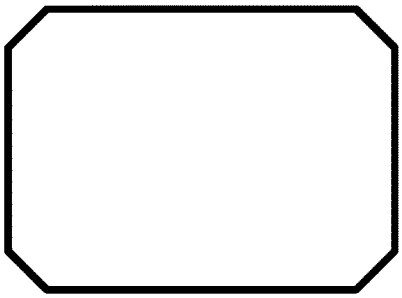
FIG. 4D illustrates a cross-sectional view taken from a direction orthogonal to a long axis of a portion of an exemplary leg or side member of the present invention, corresponding to a shape of an octagonal irregular polygon.
Figure 4E:
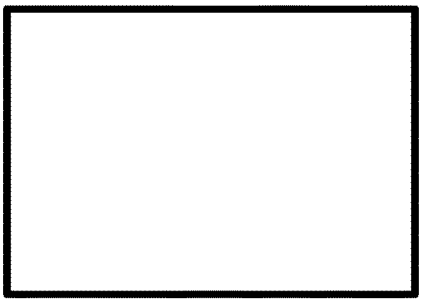
FIG. 4E illustrates a cross-sectional view taken from a direction orthogonal to a long axis of a portion of an exemplary leg or side member of the present invention, corresponding to a shape of a quadrilateral irregular polygon.
Figure 4F:
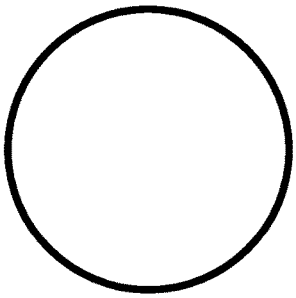
FIG. 4F illustrates a cross-sectional view taken from a direction orthogonal to a long axis of a portion of an exemplary leg or side member of the present invention, corresponding to a circular shape.
Figure 4G:
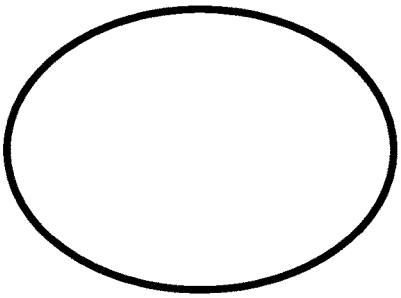
FIG. 4G illustrates a cross-sectional view taken from a direction orthogonal to a long axis of a portion of an exemplary leg or side member of the present invention, corresponding to an elliptical shape.

More particularly, at least a portion of the side members 1 and the leg members 2, such as the respective insertion sections 7 and 9, may have a polygonal cross-sectional structure having at least three sides, such as a triangle, a quadrilateral (see, e.g., FIG. 4C, or 4E), a pentagon, a hexagon (see, e.g., FIG. 4B), and other types of polygons. The cross-sectional structure may take the form a regular polygon, as illustrated, for example, in FIGS. 4A-4C, an irregular polygon as illustrated, for example, in FIGS. 4D and 4E, or in alternate embodiments even a non-polygonal elliptical shape as illustrated in FIG. 4G, or any other shape that provides resistance against rotational forces/torques about the central long axis of the member when the member is disposed within a cavity approximating the cross-sectional shape of such member. Accordingly, the illustrated insertion channels 4 and 5 also have a regular octagonal internal cross-sectional profile, which, when receiving the respective octagonally-profiled insertion sections 7 and 9, are configured to resist rotation thereof about their respective central long axes and thus reduce shear force loads that may impinge upon the retention pin 6. In various embodiments, the insertion sections 7 of the side members 1 comprise polygonal (regular or irregular) cross-sectional shapes and the side member insertion channels 4 comprise a similar polygonal (regular or irregular) cross-sectional shapes while at least a portion of such members 1 situated between the insertion sections 7 thereof may comprise a non-polygonal shape. In one further embodiment, a cross-sectional shape of the insertion sections 7 may comprise an elliptical shape, and the side member insertion channels 4 comprise a similar elliptical shape. In additional embodiments, the insertion sections 9 of the leg members 2 comprise a polygonal (regular or irregular) cross-sectional shape and the leg member insertion channels 5 comprise a similar polygonal (regular or irregular) cross-sectional shape while at least a portion of such leg members 2 outside of the insertion sections 9 thereof may comprise a non-polygonal shape. In one further embodiment, a cross-sectional shape of the insertion sections 9 may comprise an elliptical shape, and the leg member insertion channels 5 comprise a similar elliptical shape. Alternatively, the side members 1 and the leg members 2 may have cross sections that are of an irregular polygon structure, in which case the corresponding side member insertion channels 4, leg member insertions channels 5 and at least a portion of the locking seats 11 would have similarly-profiled irregular polygon cross sections. In yet another embodiment, side members 1 and/or leg members 2 may include a circular cross section such as illustrated in FIG. 4F at a location other than a respective side member insertion section 7 or leg member insertion section 9.

In one embodiment, a locking seat 11 is adapted to be mounted inside the joint 3 within a side member insertion channel 4. A retention pin 6 is slidably mounted within the locking seat 11. A positioning spring 12 is installed to surround the retention pin 6 and is mounted between the retention pin 6 and the locking seat 11. The positioning spring 12 thus provides for an extensional force to actuate and retain the retention pin 6 in an extended position thereof. A via hole 13 is provided in the side member insertion section 7 at a position corresponding to a position of the retention pin 6 when the side member insertion section 7 of a side member 1 is fully inserted within the side member insertion channel 4 of the joint 3. The retention pin 6 is configured to extend through the via hole 13 in the side member insertion section 7 of the side member 1 and into and through the locking hole 19, thus providing a shear-force-resisting connection to retain the side member 1 within the joint 3. The locking seat 11 further comprises a flange ring 14 that includes protrusions 15 disposed on a side wall of the flange ring 14. The protrusions 15 are located on the flange ring 14 to correspond to respective locations of clamping grooves 16 that are provided in an inner wall of the side member insertion channel 4. Accordingly, when the locking seat 11 with flange ring 14 is installed within the side member insertion channel 4 of the joint 3, the protrusions 15 are aligned and positioned within the clamping grooves 16 of the joint 3. The protrusions 15 each include an inclined guide surface 17.

Two reinforcing rib plates 18 are arranged on an outer wall of the joint 3 between either of the side member insertion channels 4 and the leg member insertion channel 5. A locking hole 19 is formed between each pair of the two reinforcing rib plates 18 on the outer wall of the joint 3, and the retention pin 6 is configured to extend into one of such locking holes 19.

The side member insertion sections 7 of side members 1 and the side member insertion channels 4 of the joint 3 comprise similar cross-sectional shapes, (a polygonal shape, for example), such that circumferential locking is provided upon insertion of a side member 1 into the joint 3, thereby preventing the side member 1 and the joint 3 from rotating with respect to each other. The leg member insertion section 9 of the leg member 2 and the leg member insertion channel 5 of the joint 3 also comprise complementary cross-sectional shapes, such as polygonal shapes, such that circumferential locking is provided upon insertion of the leg member 2 into the joint 3, thereby preventing the installed leg member 2 and the joint 3 from rotating with respect to each other. Such rotation-resisting structures (e.g., having mutually complementary non-circular cross-sections) maximizes stability of the whole swimming pool frame 100. The retention pin 6 connected between the side member 1 and the joint 3 is therefore not subjected to a circumferential load force or torque forces with respect to the central axis of the side members 1 and the joints 3.

In an alternate embodiment, a locking seat 11 is adapted to be mounted inside the side member insertion section 7 at the end of the side member 1, and a fixing pin 6 is mounted on the locking seat 11. A positioning spring 12 is mounted between the fixing pin 6 and the locking seat 11 and provides for an extensional force to retain the fixing pin 6 in an extended position thereof wherein the fixing pin 6 extends through a via hole 13. The via hole 13 is provided in the side member insertion section 7 at a position corresponding to a position of the fixing pin 6 when the locking seat 11 is fully installed within the side member insertion section 7. The fixing pin 6 passes through the via hole 13 when the locking seat 11 is installed inside of the side member insertion section 7. A flange ring 14 is provided at an end of the locking seat 11 and, when the locking seat 11 is inserted into the side member insertion section 7 of the side member 1, the flange ring 14 is supported on an end face of an opening of the side member insertion section 7. Protrusions 15 are provided on a side wall of the flange ring 14, corresponding clamping grooves 16 are provided in an inner wall of the side member insertion channel 4, and when the loading seat 11 and flange ring 14 is installed, the protrusions 15 are disposed within the clamping grooves 16. The protrusions 15 each include an inclined guide surface 17. A locking hole 19 is formed between the two reinforcing rib plates 18 on the outer wall of the joint 3, and the fixing pin 6 is configured to be extended into the locking hole 19.

Figure 3:
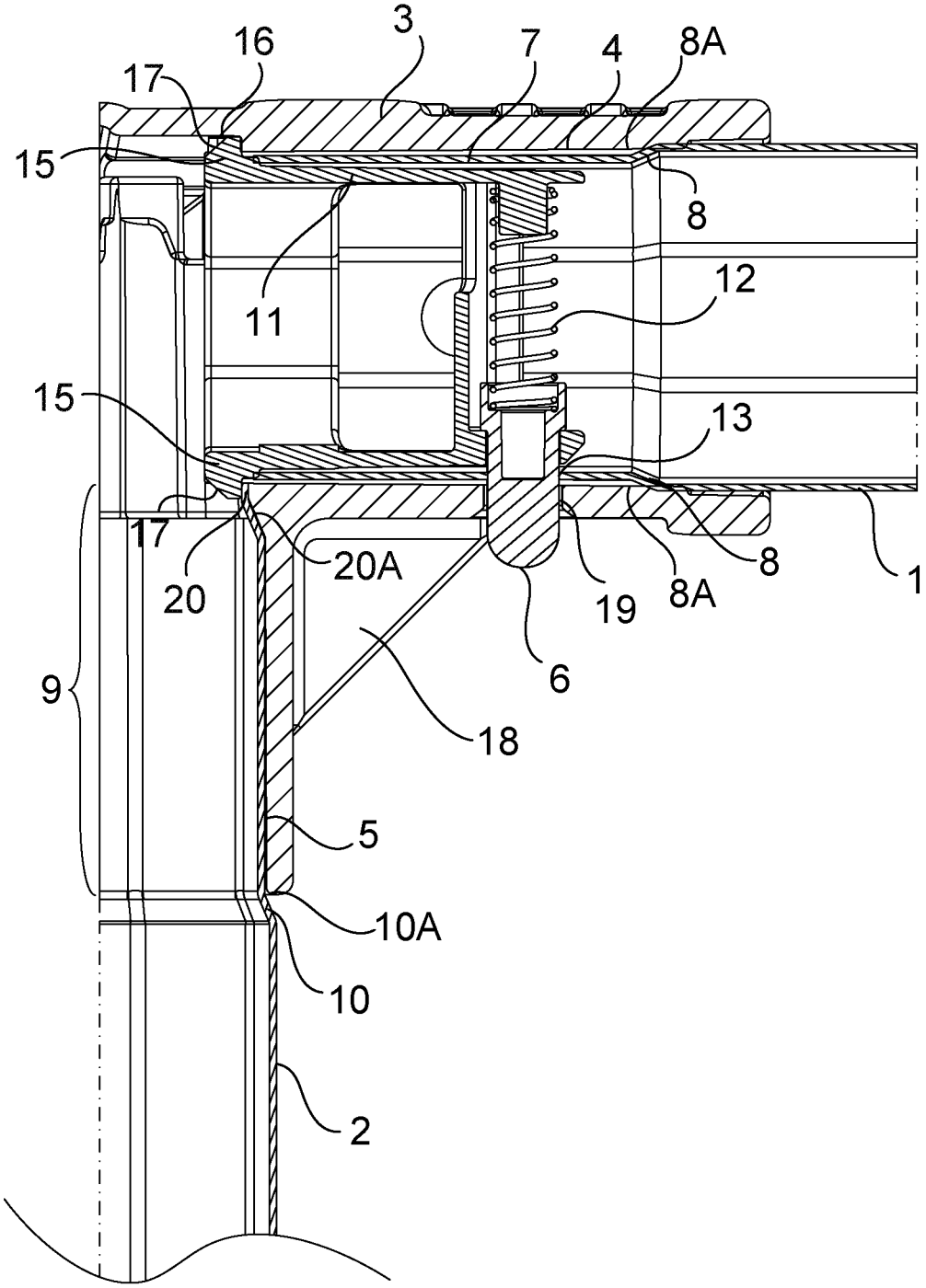
FIG. 3 is a cross-sectional view showing a joint connection according to another example embodiment.
Figure 3A:
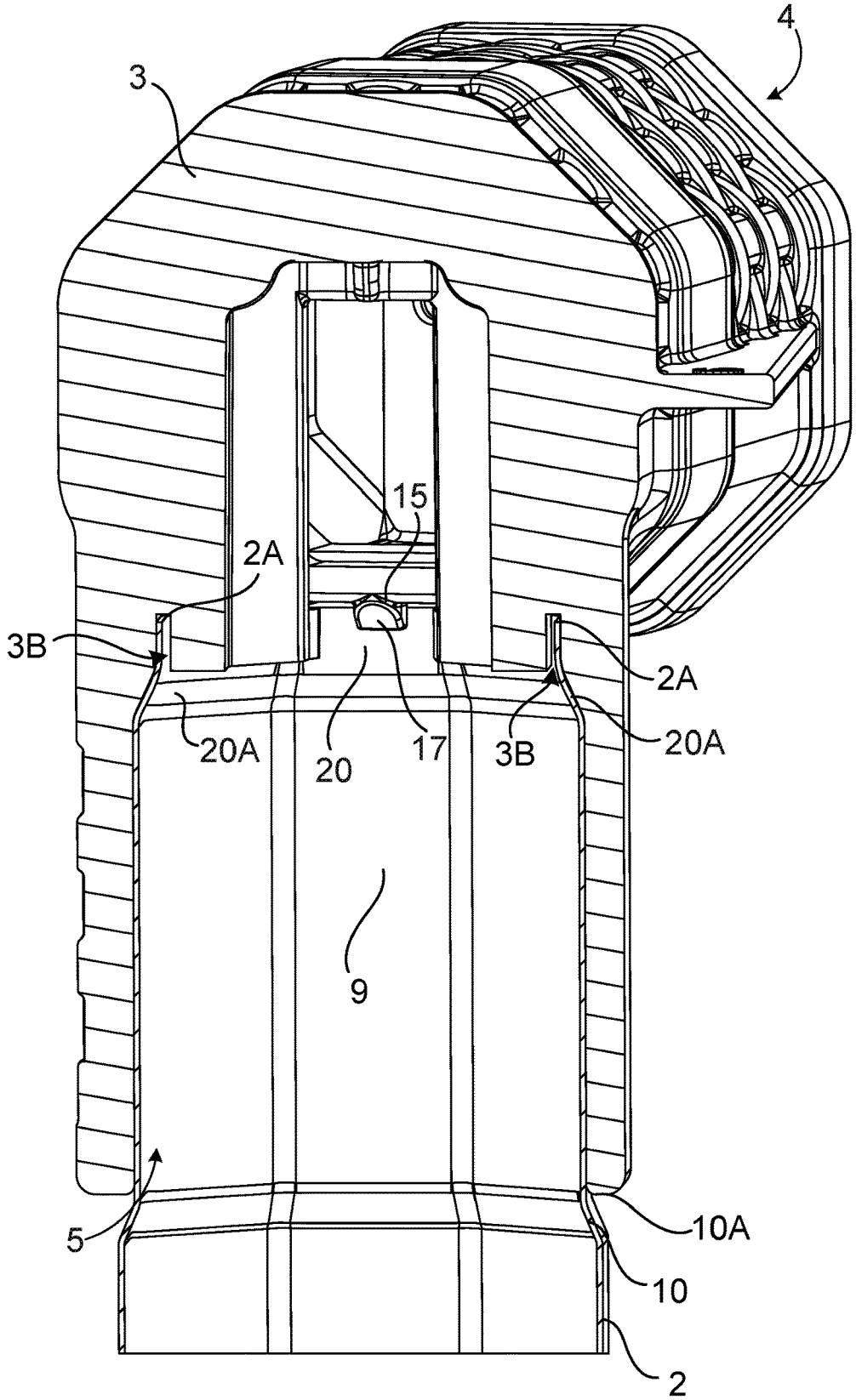
FIG. 3A illustrates another cross-sectional view showing a joint connection to an installed leg member according to another example embodiment.

According to a second example embodiment, shown in FIGS. 3 and 3A, a joint 3 of a swimming pool frame 100 comprises a structure similar to that of the first example embodiment. In this illustrated example embodiment, an upper edge 2A of the leg member 2 is seated within a joint groove 3B and further extends to a clamping groove 16 (see also FIG. 2) disposed at a lower side of the side member insertion channel 4. One of the protrusions 15, disposed at a lower side of the locking seat 11, is clamped to an inner wall of an upper end of the leg member 2 that comprises a clamping section 20. The clamping section 20 is formed by swaging an end of the leg member insertion section 9 of the leg member 2 proximate the upper edge 2A of the leg member 2, and a distal bevel 20A may be formed between the clamping section 20 and the remainder of the leg member insertion section 9. The protrusion 15 at the lower side of the locking seat 11 is clamped on an inner wall of the clamping section 20. The remaining structure is similar to that described above with respect to the first example embodiment. When the leg member 2 is inserted within the joint 3, the protrusion 15, situated at the lower side of the locking seat 11, is clamped to the inner wall of the clamping section 20 in the leg member insertion section 9 at the upper end of the leg member 2. Accordingly, an axial load on the protrusion 15 situated at the lower side of the locking seat 11 acts on the leg member 2 to provide a clamping force to assist in its retention within the joint 3. As the leg member 2 may be made of metal, and the joint 3 may be made of plastic, the leg member 2 may be stronger than the joint 3, and the joint 3 can be prevented from being damaged by an excessive axial load of the side members 1 at two sides of the joint 3 by virtue of the protrusion 15 shunting such forces to the stronger clamping section 20 of the inserted leg member 2.

It should be understood that the example embodiments described herein may be considered in a descriptive sense only and not for purposes of limitation. Descriptions of features or aspects within each example embodiment may be considered as available for other similar features or aspects in other example embodiments. While example embodiments have been described with reference to the figures, it will be understood by those of ordinary skill in the art that various changes in form and details may be made therein without departing from the spirit and scope as defined by the following claims. For example, the side members 1 and leg members 2 are each shown to have a regular polygonal cross-sectional shape, but those skilled in the art understand that the side members 1 and/or the leg members 2 may have an irregular polygonal or elliptical cross-sectional shape. Moreover, whether regular or irregular polygonal cross sectional shapes are employed for the side members 1, those skilled in the art understand that the cross sectional shapes may be utilized at the ends of the side members 1 to connect to a joint 3, while between the ends of the side members 1 a shape other than cross sectional may be utilized. Similarly, whether regular or irregular polygonal cross sectional shapes are employed for the leg members 2, those skilled in the art understand that a polygonal or elliptical cross sectional shape may be utilized at an upper connection end of the leg member 2 to connect to a joint 3, while a portion of such leg member disposed outside of the leg member insertion section 9 may comprise a shape other than a cross-sectional polygon or elliptical form. Those of skill in the art understand that while the side members 1 and/or leg members 2 may include polygonal and/or elliptical cross-sectional shapes within their respective insertion sections, the side members 1 and/or leg members 2 may comprise non-polygonal cross-sectional shapes elsewhere along their respective lengths. For example, a circular, elliptical, or other cross-sectional shape may be utilized at any point along the lengths of the side members 1 and/or leg members 2 outside of their respective insertion sections. Additionally, the respective cross-sectional shapes need not be defined by identical topology, but are configured so that the insertion channel of the joint may receive the inserted side member insertion section and resist rotation about the member's central long axis. In some exemplary embodiments, the complementary shapes of the member and the channel, that is, the cross-sectional shape and size of the insertion channel that is configured to receive the insertion section are of the same topology; for example, cross-sectional shape of both the insertion channel and insertion section to be placed therein comprise polygons of the same number of sides and configuration, both are regular octagons, or both irregular polygons or both elliptical, but various different topological shapes may be utilized between the insertion channels and the insertion sections to provide for rotational locking.

What is claimed is:

1. A swimming pool frame, comprising:

a plurality of horizontal members, each of the plurality of horizontal members including respective ends having respective horizontal member insertion sections with respective non-circular cross-sectional shapes, the horizontal members being configured to be connected together to form a frame bounding an interior area;

a plurality of support members, each of the plurality of support members including a support member insertion section at an end thereof, the support member insertion section having a non-circular cross-sectional shape;

a plurality of joints, each configured to be connected between two adjacent horizontal members and one of the support members, each of the plurality of joints comprising:

two horizontal member insertion channels having a non-circular internal cross-sectional shape, wherein the horizontal member insertion channels are configured to receive an end of one of the plurality of horizontal members in one of the two horizontal member insertion channels and an end of another one of the plurality of horizontal members in the other of the two horizontal member insertion channels;

a support member insertion channel having a non-circular internal cross-sectional shape configured to receive an end of one of the plurality of support members in the support member insertion channel; and a retention pin configured to be inserted through and retained between each horizontal member insertion channel and an end of a corresponding one of the plurality of horizontal members;

wherein each end of each of the plurality of horizontal members comprises a horizontal member insertion section formed by swaging the end of the horizontal member to a reduced diameter thereof, the horizontal member insertion section configured to be inserted into a corresponding horizontal member insertion channel of one of the plurality of joints, and each end of each of the plurality of horizontal members further comprises a bevel formed between the horizontal member insertion section and a middle portion of the horizontal member.

2. The swimming pool frame according to claim 1, wherein the horizontal member insertion sections of each of the plurality of horizontal members have a cross-sectional shape comprising one of a regular polygonal shape, an irregular polygonal shape, or an elliptical shape.

3. The swimming pool frame according to claim 2, wherein the cross-sectional shape comprises a regular octagonal polygon shape.

4. The swimming pool frame according to claim 1, wherein:

an upper end of each of the plurality of support members comprises a support member insertion section formed by swaging the upper end of the support member to a reduced diameter thereof, the support member insertion section configured to be inserted into a corresponding support member insertion channel of one of the plurality of joints, and the upper end of each of the plurality of support members further comprises a bevel formed between the support member insertion section and a middle portion of the support member.

5. The swimming pool frame according to claim 4, wherein:

a clamping section of each of the plurality of support members is formed by swaging a top end of each of the support member insertion sections proximate an upper edge of each of the plurality of support members to a second reduced diameter thereof, each clamping section configured to be inserted into a corresponding clamping groove of one of the plurality of joints; and a distal bevel is formed between each of the clamping sections of each of the plurality of support members and the respective support member insertion sections of each of the plurality of support members.

6. The swimming pool frame according to claim 4, wherein the support member insertion section of each of the plurality of support members has a cross-sectional shape comprising one of a regular polygonal shape, an irregular polygonal shape, or an elliptical shape.

7. The swimming pool frame according to claim 6, wherein the cross sectional shape comprises a regular octagonal polygon shape.

8. The swimming pool frame according to claim 1, further comprising:

a plurality of locking seats, each configured to mount inside an internal end of a horizontal member insertion channel of one of the plurality of joints, wherein each of the plurality of retention pins is mounted on one of the plurality of locking seats.

9. The swimming pool frame according to claim 8, wherein each of the plurality of locking seats comprises:

a flange ring disposed at an end of the locking seat and configured to be supported on an end face of an opening of one of the plurality of horizontal members when one of the horizontal member insertion sections of the one of the plurality of horizontal members is inserted within the horizontal member insertion channel.

10. The swimming pool frame according to claim 9, wherein each of the plurality of locking seats further comprises:

a plurality of protrusions extending radially outward from the flange ring, wherein each horizontal member insertion channel of each of the plurality of joints includes a plurality of clamping grooves disposed at positions corresponding to positions of the plurality of protrusions, such that the protrusions are disposed within the clamping grooves when one of the plurality of locking seats is mounted inside of the horizontal member insertion channel.

11. The swimming pool frame according to claim 10, wherein each of the plurality of support members, the plurality of joints, and the plurality of locking seats are physically shaped such that, upon insertion of the support member insertion section of one of the plurality of support members into the support member insertion channel of one of the plurality of joints where of one of the plurality of locking seats has been mounted into the horizontal member insertion channel of the one of the plurality of joints, a clamping section formed in the support member insertion section proximate an upper edge of the support member extends to the lower horizontal of the horizontal member insertion channel, and one of the plurality of protrusions clamps onto on an inner wall of the support member within the clamping section.

12. The swimming pool frame according to claim 1, wherein each of the plurality of joints further comprises:

a pair of reinforcing rib plates disposed on an outer wall of the joint and extending between each of the horizontal member insertion channels and the support member insertion channel, and a locking hole formed through the outer wall of the joint between each pair of reinforcing rib plates, wherein the retention pin is insertable into the locking hole.

13. The swimming pool frame according to claim 8, wherein a portion of each of the locking seats has a cross-sectional shape comprising one of a regular polygonal shape, an irregular polygonal shape, or an elliptical shape.

14. A swimming pool joint unit comprising:

a frame joint comprising:

a pair of horizontal member insertion channels, each having a first polygonal cross-sectional shape and each configured to receive therein an end of a horizontal member, each of the pair of horizontal member insertion channels comprising a locking hole formed through an outer wall thereof;

a support member insertion channel having a second polygonal cross-sectional shape and configured to receive therein an end of a support member;

a first pair of reinforcing rib plates disposed on an outer wall of the joint and extending between the support member insertion channel and a first one of the pair of horizontal member insertion channels; and a second pair of reinforcing rib plates disposed on the outer wall of the joint and extending between the support member insertion channel and a second one of the pair of horizontal member insertion channels, wherein a first locking hole is formed through the outer wall of the first one of the pair of horizontal member insertion channels between the first pair of reinforcing rib plates, and a second locking hole is formed through the outer wall of the second one of the pair of horizontal member insertion channels between the second pair of reinforcing rib plates.

15. The swimming pool joint unit according to claim 14, wherein each of the first polygonal cross-sectional shape and the second polygonal cross-sectional shape is a regular polygonal shape.

16. The swimming pool joint unit according to claim 14, wherein each of the first polygonal cross-sectional shape and the second polygonal cross-sectional shape is an irregular polygonal shape.

17. The swimming pool joint unit according to claim 14, further comprising:

a first locking seat configured to fit within a first one of the pair of horizontal member insertion channels and comprising a first flange ring and a first retention pin configured to extend through the locking hole of the first one of the pair of horizontal member insertion channels; and a second locking seat configured to fit within a second one of the pair of horizontal member insertion channels and comprising a second flange ring and a second retention pin configured to extend through the locking hole of the second one of the pair of horizontal member insertion channels.

18. The swimming pool joint according to claim 17, wherein:

the first locking seat further comprises a plurality of first protrusions extending radially outward from the first flange ring;

the second locking seat further comprises a plurality of second protrusions extending radially outward from the second flange ring; and the frame joint further comprises:

a first plurality of clamping grooves formed within the first one of the pair of horizontal member insertion channels and configured to accept the plurality of first protrusions when the first retention pin is extended through and retained within the locking hole of the first one of the pair of horizontal member insertion channels; and a second plurality of clamping grooves formed within the second one of the pair of horizontal member insertion channels and configured to accept the plurality of second protrusions when the second retention pin is extended through and retained within the locking hole of the second one of the pair of horizontal member insertion channels.

19. A swimming pool frame, comprising:

a plurality of horizontal members, each of the plurality of horizontal members including respective ends having respective horizontal member insertion sections with respective non-circular cross-sectional shapes, the horizontal members being configured to be connected together to form a frame bounding an interior area;

a plurality of support members, each of the plurality of support members including a support member insertion section at an end thereof, the support member insertion section having a non-circular cross-sectional shape;

a plurality of joints, each configured to be connected between two adjacent horizontal members and one of the support members, each of the plurality of joints comprising:

two horizontal member insertion channels having a non-circular internal cross-sectional shape, wherein the horizontal member insertion channels are configured to receive an end of one of the plurality of horizontal members in one of the two horizontal member insertion channels and an end of another one of the plurality of horizontal members in the other of the two horizontal member insertion channels;

a support member insertion channel having a non-circular internal cross-sectional shape configured to receive an end of one of the plurality of support members in the support member insertion channel; and a retention pin configured to be inserted through and retained between each horizontal member insertion channel and an end of a corresponding one of the plurality of horizontal members;

wherein an upper end of each of the plurality of support members comprises a support member insertion section formed by swaging the upper end of the support member to a reduced diameter thereof, the support member insertion section configured to be inserted into a corresponding support member insertion channel of one of the plurality of joints, and the upper end of each of the plurality of support members further comprises a bevel formed between the support member insertion section and a middle portion of the support member.

20. A swimming pool frame, comprising:

a plurality of horizontal members, each of the plurality of horizontal members including respective ends having respective horizontal member insertion sections with respective non-circular cross-sectional shapes, the horizontal members being configured to be connected together to form a frame bounding an interior area;

a plurality of support members, each of the plurality of support members including a support member insertion section at an end thereof, the support member insertion section having a non-circular cross-sectional shape;

a plurality of joints, each configured to be connected between two adjacent horizontal members and one of the support members, each of the plurality of joints comprising:

two horizontal member insertion channels having a non-circular internal cross-sectional shape, wherein the horizontal member insertion channels are configured to receive an end of one of the plurality of horizontal members in one of the two horizontal member insertion channels and an end of another one of the plurality of horizontal members in the other of the two horizontal member insertion channels;

a support member insertion channel having a non-circular internal cross-sectional shape configured to receive an end of one of the plurality of support members in the support member insertion channel; and a retention pin configured to be inserted through and retained between each horizontal member insertion channel and an end of a corresponding one of the plurality of horizontal members; and a plurality of locking seats, each configured to mount inside an internal end of a horizontal member insertion channel of one of the plurality of joints, wherein each of the plurality of retention pins is mounted on one of the plurality of locking seats.

21. A swimming pool frame, comprising:

a plurality of horizontal members, each of the plurality of horizontal members including respective ends having respective horizontal member insertion sections with respective non-circular cross-sectional shapes, the horizontal members being configured to be connected together to form a frame bounding an interior area;

a plurality of support members, each of the plurality of support members including a support member insertion section at an end thereof, the support member insertion section having a non-circular cross-sectional shape;

a plurality of joints, each configured to be connected between two adjacent horizontal members and one of the support members, each of the plurality of joints comprising:

two horizontal member insertion channels having a non-circular internal cross-sectional shape, wherein the horizontal member insertion channels are configured to receive an end of one of the plurality of horizontal members in one of the two horizontal member insertion channels and an end of another one of the plurality of horizontal members in the other of the two horizontal member insertion channels;

a support member insertion channel having a non-circular internal cross-sectional shape configured to receive an end of one of the plurality of support members in the support member insertion channel; and a retention pin configured to be inserted through and retained between each horizontal member insertion channel and an end of a corresponding one of the plurality of horizontal members;

a pair of reinforcing rib plates disposed on an outer wall of the joint and extending between each of the horizontal member insertion channels and the support member insertion channel; and a locking hole formed through the outer wall of the joint between each pair of reinforcing rib plates, wherein the retention pin is insertable into the locking hole.

22. A swimming pool joint unit comprising:

a frame joint comprising:

a pair of horizontal member insertion channels, each having a first polygonal cross-sectional shape and each configured to receive therein an end of a horizontal member, each of the pair of horizontal member insertion channels comprising a locking hole formed through an outer wall thereof; and a support member insertion channel having a second polygonal cross-sectional shape and configured to receive therein an end of a support member;

a first locking seat configured to fit within a first one of the pair of horizontal member insertion channels and comprising a first flange ring and a first retention pin configured to extend through the locking hole of the first one of the pair of horizontal member insertion channels; and a second locking seat configured to fit within a second one of the pair of horizontal member insertion channels and comprising a second flange ring and a second retention pin configured to extend through the locking hole of the second one of the pair of horizontal member insertion channels.

* * * * *